United States Patent [19]

Wirz et al.

[11] 4,327,135

[45] Apr. 27, 1982

[54] SHEET-GUIDING FOIL AS A COVERING FOR IMPRESSION CYLINDERS

[75] Inventors: Arno Wirz, Bammental; Peter Sobotta, Heidelberg; Franz Arendt, Walldorf; Otto K. Gramlich, Mannheim, all of Fed. Rep. of Germany

[73] Assignee: Heidelberger Druckmaschinen Aktiengesellschaft, Heidelberg, Fed. Rep. of Germany

[21] Appl. No.: 141,670

[22] Filed: Apr. 18, 1980

[30] Foreign Application Priority Data

Apr. 24, 1979 [DE] Fed. Rep. of Germany ..... 2916505

[51] Int. Cl.[3] ..... B41F 1/20

[52] U.S. Cl. ..... 428/600; 428/164; 428/172; 428/908; 428/909; 101/422

[58] Field of Search ..... 428/908, 909, 164, 172, 428/600; 101/422

[56] References Cited

U.S. PATENT DOCUMENTS

| | | | |
|---|---|---|---|
| 705,294 | 7/1902 | Rhodes | 428/909 |
| 1,778,185 | 10/1930 | De Vries | 428/909 |
| 2,555,319 | 6/1951 | Cross | 101/422 |
| 2,804,417 | 8/1957 | Cross et al. | 428/909 |
| 3,152,035 | 10/1964 | Kirchner | 428/164 |
| 3,473,952 | 10/1969 | McFadden | 428/164 |

*Primary Examiner*—Brooks H. Hunt

*Attorney, Agent, or Firm*—Herbert L. Lerner; Laurence A. Greenberg

[57] ABSTRACT

A sheet-guiding foil as a sheath for an impression cylinder in rotary offset perfecting presses, one surface of the foil being smooth while the opposite surface thereof is formed with spherical calottes of equal height and of statistically uniform distribution, including a chemically resistant, wear-resistant and rigid backing layer with good ink transfer behavior and a textured surface, and a thin chromium layer applied thereto for evening out microroughness, and the method of production.

3 Claims, 3 Drawing Figures

SHEET-GUIDING FOIL AS A COVERING FOR IMPRESSION CYLINDERS

The invention relates to a sheet-guiding foil as a sheath or covering for impression cylinders on rotary offset perfector presses, one surface of the foil being smooth while the opposite surface thereof is provided with spherical calottes of equal height and a statistically uniform distribution.

German Pat. No. 12 58 873 discloses roughening of an aluminum sheet or the casing surface of perfecting or sheet-guiding cylinders, for example, by means of sandblasting and then coating it with a thin chromium layer. The supporting areas of the thus produced surface are irregular in height and differ in size. Relatively pointed support areas are, naturally, worn down more rapidly by the paper than flat areas. The base or backing material, such as steel or aluminum, for example, shows through at the worn points. The ink transfer behavior of these exposed areas of the backing material is so poor that the entire cylinder-casing surface is no longer suitable for guiding freshly printed sheets during the perfecting operation. Furthermore, the chemical agents used in the offset process penetrate into these heavily worn areas, causing corrosion.

DE-OS No. 28 20 549 describes, in addition, a metallic sheet-guiding foil which is formed of at least two layers. An aluminum or copper base or backing layer is roughened on one side thereof by sandblasting and is nickel-plated. This second layer which is formed of nickel can have a further thin layer of solid nickel applied thereto.

The roughening of the base or backing layer by a sandblasting operation produces supporting areas which are of uneven or unequal height and differ in size. The ink removed from the freshly printed underside of the sheet during the printing process is, therefore, redeposited nonuniformly when leaving the printing gap. This results in ink redistribution and, thereby, in a deterioration of the printed image. Furthermore, because of the excessive size of and excessive disparity between the valleys, such a sheet-guiding surface is an inadequate support for the sheet during the perfecting operation i.e. during printing on the reverse side of the sheet.

A three-layer sheet-guiding surface has the disadvantage, moreover, that the texture of the roughened surface fades. The valleys become narrower and the supporting plateaus become greater. This results in a deterioration of the ink transfer behavior of a three-layer sheet-guiding foil. Furthermore, it is difficult to bend the ends of three-layer sheet-guiding foils for the purpose of clamping them in position since the solid nickel layer tends to crack.

It is accordingly an object of the invention to provide such sheet-guiding foils having an extended service life, improved ink transfer behavior and, above all, to keep the ink transfer behavior thereof more or less constant over the entire service life of the foil.

With the foregoing and other objects in view, there is provided, in accordance with the invention, a sheet-guiding foil as a sheath for an impression cylinder in rotary offset perfecting presses, one surface of the foil being smooth while the opposite surface thereof is formed with spherical calottes of equal height and of statistically uniform distribution, comprising a chemically resistant wear-resistant and rigid backing layer with good ink transfer behavior and a textured surface, and a thin chromium layer applied thereto for evening out micro-roughness.

The ink transfer behavior of a surface is dependent upon the texture and material thereof. The construction of the supporting surfaces in the form of spherical calottes promotes the removal of ink which has been received. Materials, such as chromium, nickel, chrome-nickel-steel or certain specific plastics, additionally promote ink transfer.

The backing layer is formed, in accordance with alternate features of the invention, for example, of a nickel foil produced by means of electroforming, of a chrome-nickel-steel sheet processed by etching or embossing or of foils formed of compression-molded plastic material having a high modulus of elasticity, such as rigid polyamide foils, for example. The applied chromium layer may, for example, have a thickness of 0.01 to 0.03 mm. The chromium layer markedly evens out the microroughness of a nickel, chrome-nickel-steel or plastic-material layer, thereby providing a smoother surface than that of the backing layer.

A result thereof is that a chromium-plated, sheet-guiding foil exhibits optimum ink transfer behavior even in the start-up phase and is quicker to wash than the initially somewhat rougher backing layer.

Above all, however, the service life of the sheet-guiding foil is extended by the life of the very hard chromium layer. The ink transfer behavior of such a chromium-plated, sheet-guiding foil remains virtually constant over the entire service life of the foil, because, after the very thin chromium layer has worn down at the sheet-supporting areas, the backing layer which comes through likewise has good ink transfer behavior.

It is especially advantageous, in accordance with another feature of the invention, to use pure nickel as backing layer, because the chemical resistances of chromium and nickel to the chemicals used in offset printing complement each other. Thus, for example, the thin chromium layer may be damaged by the application of certain cleaning agents. Nickel, however, is resistant to such cleaning agents. Conversely, certain dampening-solution additives, in conjunction with local tap water, may attack nickel. Chromium is resistant to such chemicals. The thin chromium layer thus prevents premature wear on a nickel foil when using disadvantageous dampening solution additives.

Since the thin chromium layer is not only hard, but also brittle, it would very easily flake off when bending the clamping ends of a sheet-guiding foil. For this reason, it is advantageous, in accordance with an added feature of the invention, to bend the clamping ends of the backing layer before the chromium layer is applied.

Other features which are considered as characteristic for the invention are set forth in the appended claims.

Although the invention is illustrated and described herein as embodied in a sheet-guiding foil as a covering for impression cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
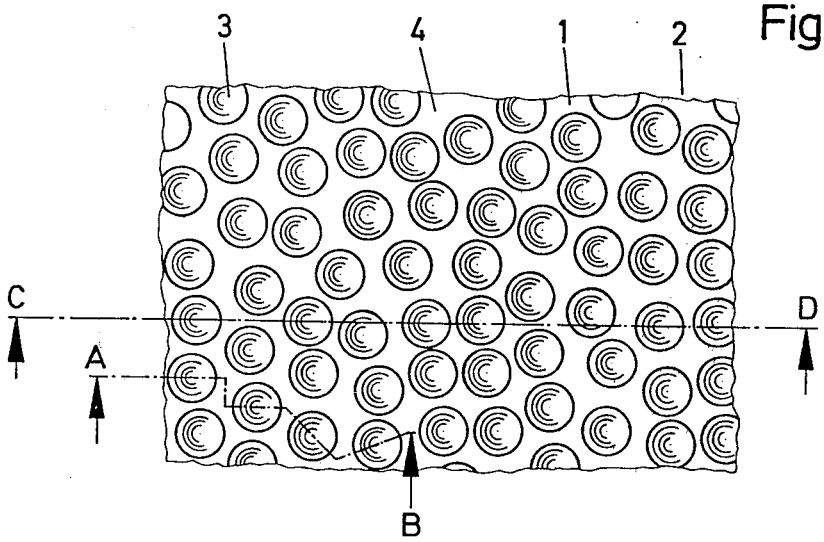
FIG. 1 is a fragmentary top plan view of a sheet-supporting foil according to the invention, showing the textured surface thereof.

Referring now to the drawing and first, particularly, to FIG. 1 thereof, there is shown the textured surface 1 of a sheet-guiding foil 2 covered by support regions in the form of spherical calottes 3. These spherical calottes 3 have a statistically uniform distribution i.e. the distribution thereof is not symmetrical, but is nearly symmetrical, however. Statistically uniform also means that there are approximately the same number of spherical calottes 3 on a respective unit area. This ensures that the interspaces, the valleys 4, do not essentially differ from one another with regard to the size and shape thereof. Fundamentally, therefore, a uniform support for a sheet which is to be printed is also ensured.

Figure 3:
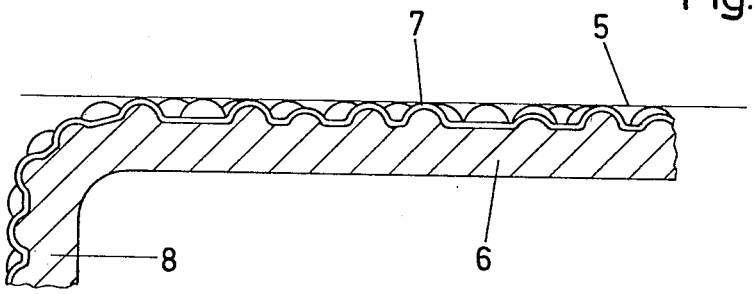
FIG. 3 is a sectional view of FIG. 1 taken along the line C–D.
Figure 2:
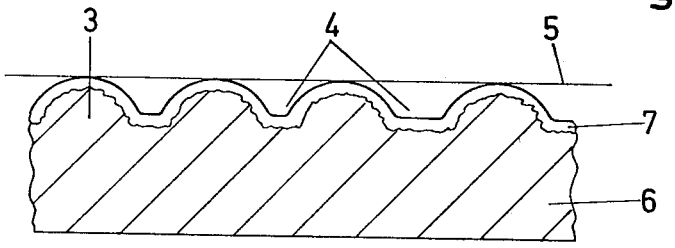
FIG. 2 is an enlarged sectional view of FIG. 1 taken along the line A–B.

As is apparent from FIGS. 2 and 3, the spherical calottes 3 are all of equal height. The domes of the spherical calottes 3 thus form or define a support plane 5. The calotte or hemispherical shape of the support areas or regions and the formation of the support plane 5 ensure an excellent support for the sheet of which the reverse side is to be printed. This disposition of the spherical calottes 3 also prevents premature wear of the more elevated support areas or regions, as occurs with heretofore-known sheet-supporting foils of this general type.

As shown in FIG. 2, the sheet-guiding foil 2 is formed of two layers, namely a base or backing layer 6 of nickel, and an upper layer 7 of chromium. The backing layer 6 may, for example, be produced by an electroforming process, following which however, the supporting domes yet have a relatively great microroughness. The thin chromium layer 7 may be applied in a different bath. The surface thereof becomes considerably smoother than that of the backing layer 6. Such a sheet-supporting foil thereby has equally good ink transfer properties or behavior from the very beginning of use thereof, whereas, when using the backing layer alone as the foil, optimum ink transfer properties are not obtained until after a given smoothing of the microroughness has taken place. It is also easier to wash the chromium-plated surface than the slightly rougher surface of the base or backing layer 6.

After production of the backing layer 6 by electroforming, it is necessary, first of all, to fold or bend the clamping edges 8 before the cover layer 7 is applied in the chrome bath.

The hereinaforedescribed embodiment of the invention may be modified to an extent wherein, instead of the nickel backing layer 6 produced by electroforming, use is made of an embossed or etched chrome-nickel-steel sheet or an embossed or etched foil of plastic material e.g. a rigid thermoplast formed of PVC, polyester or polyamide, or glass which is suitable with respect to providing good ink transfer properties and behavior. The thermoplast must, however, exhibit a high modulus of elasticity, because it would otherwise yield in the printing nip between respective cylinders or rollers due to the flexing or squeezing process occurring therein and would give rise to an increase in printing width.

We claim:

1. A sheet-guiding foil as a sheath for an impression cylinder in rotary offset perfecting presses, comprising a chemically resistant, wear-resistant and rigid backing layer with good ink transfer behavior formed entirely of nickel, chrome-nickel-steel or a plastic material having a high modulus of elasticity, said backing layer having a smooth rear surface and a front surface integrally formed with spherical calottes of equal height and of statistically uniform distribution, and a thin chromium layer applied to said front surface formed with said spherical calottes for evening out microroughness.

2. A sheet-guiding foil according to claim 1 wherein said plastic material is a polyamide or polyvinyl chloride.

3. Method of producing a sheet-guiding foil according to claim 1 which comprises forming rounded bends at respective clamping ends of the backing layer before applying the chromium layer thereto.

* * * * *